US009410446B2

(12) United States Patent
Benjamin et al.

(10) Patent No.: US 9,410,446 B2
(45) Date of Patent: Aug. 9, 2016

(54) DYNAMIC STABILITY AND MID AXIAL PRELOAD CONTROL FOR A TIE SHAFT COUPLED AXIAL HIGH PRESSURE ROTOR

(75) Inventors: Daniel Benjamin, Simsbury, CT (US); Daniel R. Kapszukiewicz, Plainfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 729 days.

(21) Appl. No.: 13/545,111

(22) Filed: Jul. 10, 2012

(65) Prior Publication Data

US 2014/0017087 A1 Jan. 16, 2014

(51) Int. Cl.

| | |
|---|---|
| ***F01D 25/16*** | (2006.01) |
| ***F01D 5/06*** | (2006.01) |
| *F01D 5/02* | (2006.01) |

(52) U.S. Cl.

CPC ..... *F01D 25/16* (2013.01); *F01D 5/066* (2013.01); *F01D 5/025* (2013.01); *F01D 5/026* (2013.01); *F05D 2260/37* (2013.01)

(58) Field of Classification Search

CPC ..... F01D 5/00; F01D 5/02; F01D 5/025; F01D 5/026; F01D 5/06; F01D 5/066

See application file for complete search history.

(56) References Cited

U.S. PATENT DOCUMENTS

| | | | | |
|---|---|---|---|---|
| 5,537,814 | A * | 7/1996 | Nastuk et al. | 60/796 |
| 6,267,553 | B1 | 7/2001 | Burge | |
| 6,375,421 | B1 | 4/2002 | Lammas et al. | |
| 6,579,010 | B2 | 6/2003 | Trapp et al. | |
| 7,836,596 | B2 | 11/2010 | Suciu et al. | |
| 7,912,587 | B2 | 3/2011 | Walters et al. | |
| 2010/0124495 | A1 | 5/2010 | Bifulco | |
| 2010/0158699 | A1 | 6/2010 | Makuszewski | |
| 2010/0239424 | A1 | 9/2010 | Maalouf et al. | |
| 2011/0223026 | A1 | 9/2011 | Benjamin et al. | |

FOREIGN PATENT DOCUMENTS

EP 2365184 A2 9/2011

OTHER PUBLICATIONS

International Search Report and Written Opinion for related International Application No. PCT/US2013/35624; report dated Apr. 8, 2013.

EP Supplementary European Search Report for Application No. EP13816441; Date of Mailing: Nov. 3, 2015; 10 pgs.

* cited by examiner

*Primary Examiner* — Nathaniel Wiehe
*Assistant Examiner* — Jason Davis
(74) *Attorney, Agent, or Firm* — Cantor Colburn LLP

(57) ABSTRACT

A middle support member is used to provide axial support and control to the tie shaft. The middle support member includes a high pressure compressor coupling nut that applies a preload that allows the high pressure compressor stack to be installed separately from the high pressure turbine rotor through a kickstand.

17 Claims, 3 Drawing Sheets

DYNAMIC STABILITY AND MID AXIAL PRELOAD CONTROL FOR A TIE SHAFT COUPLED AXIAL HIGH PRESSURE ROTOR

BACKGROUND

This application relates to a method of assembling a gas turbine engine, wherein both a compressor rotors and the turbine rotors are assembled using a tie shaft connection.

Gas turbine engines are known, and typically include a compressor, which compresses air and delivers it downstream into a combustion section. The air is mixed with fuel in the combustion section and combusted. Products of this combustion pass downstream over turbine rotors, driving the turbine rotors to rotate.

Typically, the compressor section is provided with a plurality of rotor serial stages, or rotor sections. Traditionally, these stages were joined sequentially one to another into an inseparable assembly by welding or separable assembly by bolting using bolt flanges, or other structure to receive the attachment bolts.

More recently, it has been proposed to eliminate the welded or bolted joints with a single coupling which applies an axial force through the compressor rotors stack to hold them together and create the friction necessary to transmit torque.

SUMMARY

A gas turbine engine has a compressor section carrying a plurality of compressor rotors and a turbine section carrying a plurality of turbine rotors. The compressor rotors and the turbine rotors are constrained to rotate together with a tie shaft. An upstream hub provides an upstream abutment face for the compressor rotors stack. A downstream hub bounds the upstream end of the compressor rotor and abuts the compressor rotor stack against the upstream hub.

The downstream hub creates a middle support used to provide radial support for a high pressure rotor and control to the tie shaft preload. The middle support also includes a high pressure compressor coupling nut that applies a preload that allows the high pressure compressor stack to be installed separately from the high pressure turbine rotor. The middle support is essential to control the dynamic stability of the long high pressure rotor spanning the distance between its forward and aft supports. The aft support includes a multiple layer interference fit between the shaft and the most downstream turbine rotor. The multi-layer fit accomplishes simultaneously radial support for the rotors stack and dynamic stability for a high pressure spool.

These and other features of the present invention can be best understood from the following specification and drawings, the following of which is a brief description.

DESCRIPTION

Figure 1:
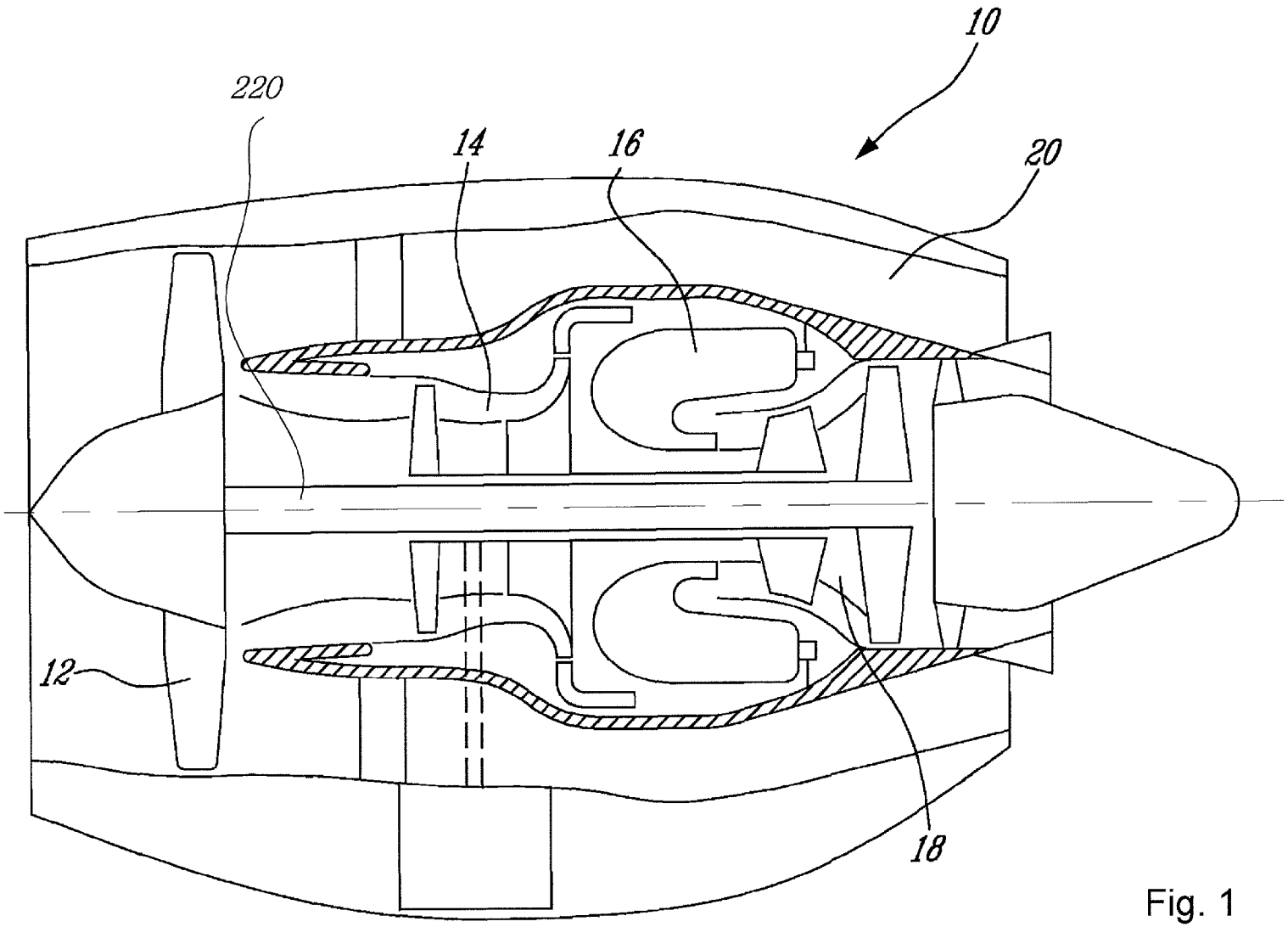
FIG. 1 is a partial sectional perspective view of a turbine engine according to the claims.

FIG. 1 illustrates a turbofan gas turbine engine 10 of a type preferably provided for use in subsonic flight, generally including a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. In the illustrated arrangement, by-pass air flows longitudinally around the engine core through a by-pass duct 20 provided within the nacelle. The compressor 14 and turbine 18 may be connected in a variety of ways, such as through a shaft, through one or more tie shafts, through a transmission, etc.

Figure 2:
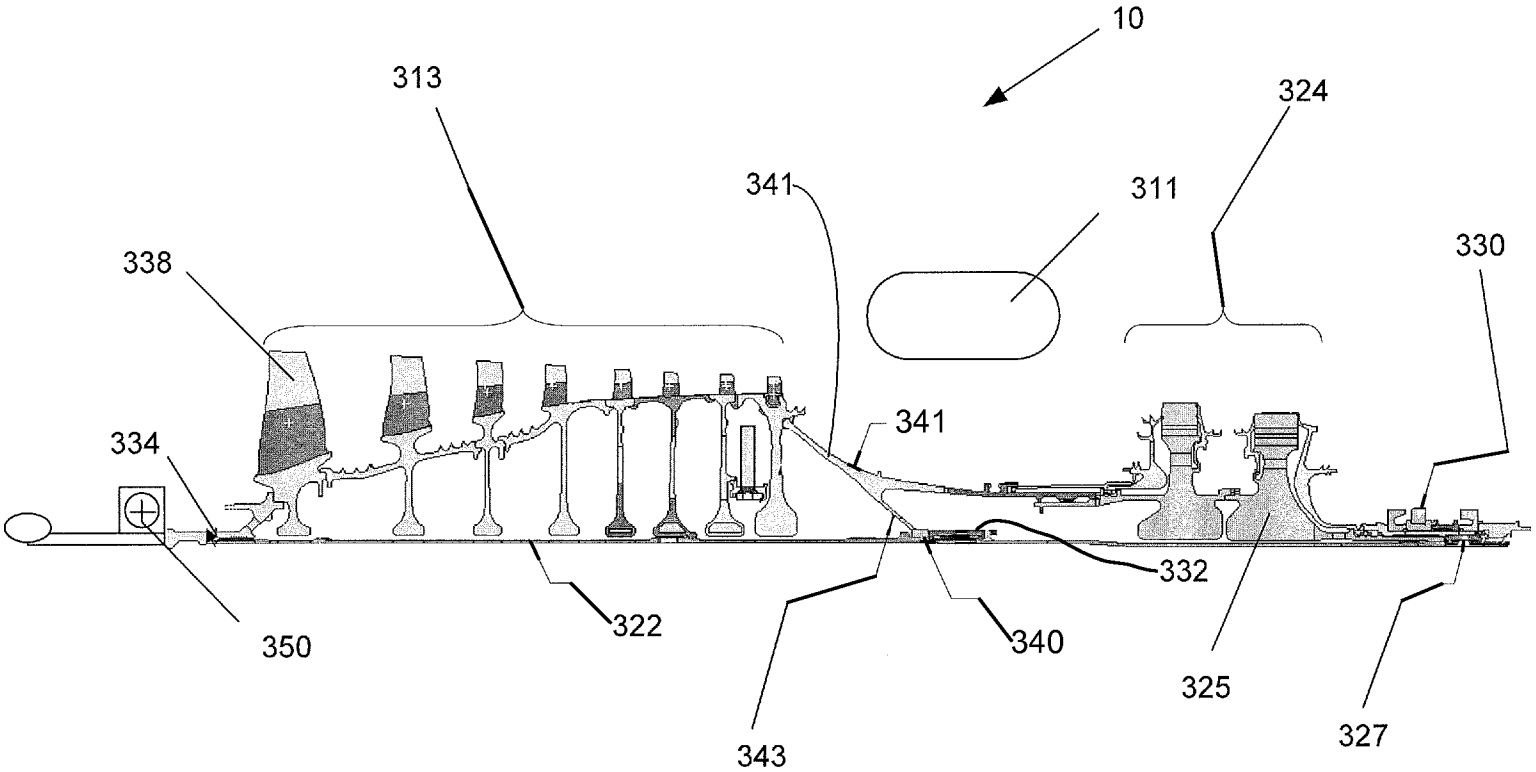
FIG. 2 is an enlarged view of the turbine engine with a middle support member according to the claims.

Referring to FIG. 2, a long span between supporting bearings 350 and 330 creates rotor dynamic problems for bearing preload and rotor stability. Bearings apart from being mounted on the shafts and housings have to be preloaded properly for their proper functioning. Preloading is the methodology by which the internal clearance in the bearing is removed by applying a permanent thrust load to it. In other terms, the bearing is pushed to such an extent that it has to move only in the groove (raceway) and cannot move axially in either direction. Preloading may be needed for several reasons such as to eliminate the radial and axial play in the bearing which would be inherently present even after a bearing is mounted radially on a shaft, eliminate all the unnecessary clearances, which may induce a rigidity to the bearings and thus to the system the bearing supports and by reducing the clearances, the rotational accuracy of the bearing may be controlled. Thus, it helps to reduce the non-repetitive run out that could occur because of the clearances.

To address these requirements, a support 340 may be provided between bearings 330, 350 and a compressor rotor stack 313 and a turbine rotor stack 324 may be configured to retain a tight radial fit with a tie shaft 322. Axial preload in the compressor rotor stack 313 and the turbine rotor stack 324 may generate the friction between adjoining rotor faces required for torque transmission. A downstream hub 341 may act as a middle support member to address these requirements. The downstream hub 341 may allow the compressor rotor stack 313 to be assembled separately with a temporary preload applied by a high pressure compressor (HPC) coupling nut 332. The HPC coupling nut 332 may be axially preloaded to satisfy dynamic stability requirements and to prevent the HPC coupling nut 332 from whirling.

Figure 3:
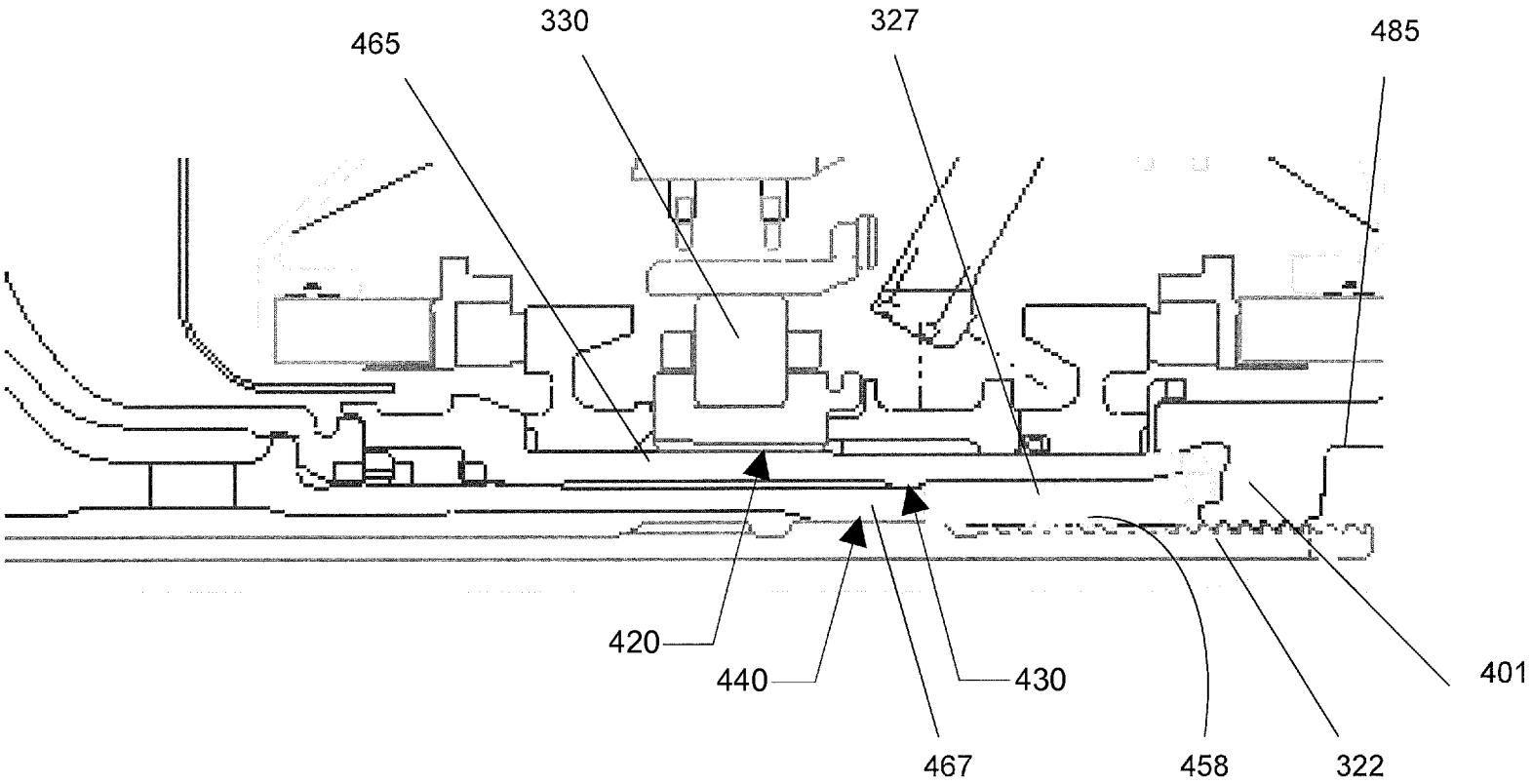
FIG. 3 is an enlarged view of a high pressure turbine rotor aft end support member according to the claims.

FIG. 2 schematically illustrates a gas turbine engine 10 incorporating a combustion section 311, shown schematically, a compressor rotor stack 313 having a plurality of compressor rotors 338, and a turbine rotor stack 324 having a plurality of turbine rotors 325. As shown, an upstream hub 334 may be threadably secured to the tie shaft 322 at the upstream side of the compressor rotor stack 313. The downstream hub 341 may be positioned downstream of the compressor rotor stack 313, and may contact the downstream-most of the compressor rotors 338. The compressor rotor stack 313 may be sandwiched between the downstream hub 341 and the upstream hub 334, and secured by the HPC coupling nut 332. The downstream hub 341 may abut the turbine rotor stack 324 which in turn may be secured with a high pressure turbine (HPT) lock nut 327 as shown in FIG. 3. A downstream lock nut 401 may bias a plurality of seals and bearings against the turbine rotors 325. The HPT lock nut 327 and the downstream lock nut 401 may be threadably engaged to the same tie shaft 322. The HPT lock nut 327 applies primary preload to the compressor rotor stack 313 and the turbine rotor stack 324. As shown in FIG. 3, the HPT lock nut 327 may be threadably received on threads 458 of the tie shaft 322. FIG. 3 illustrates the downstream lock nut 401 and the HPT lock nut 327 threadably engaged to the tie shaft 322. Initially, the upstream hub 334 (FIG. 2) may be threadably assembled to the tie shaft 322 and the compressor rotors 338 and the downstream hub 341 may be stacked together and secured by the HPC coupling nut 332 which may apply an axial preload force to hold the compressor rotors 338 against a kickstand 343 of the downstream hub 341. An internal compression load may be created in the compressor rotor stack 313 to react tension load in the tie shaft 322.

The kickstand 343 of the downstream hub 341 is designed as a soft spring to enable a secondary load path from the HPC coupling nut 332 through the kickstand 343, downstream hub 341, and compressor rotor stack 313. The secondary load path may prevent rolling and may ensure self alignment with the mating face of the HPC coupling nut 332. The kickstand 343 of the arrangement may also generate radial and axial reactions at the downstream hub 341 interface with the most downstream of the compressor rotors 338. The secondary load path applies a preload that is mostly temporary as it decreases significantly after the HPT lock nut 327 is tightened—the residual secondary preload may also create loaded contact between the kickstand 343 of the downstream hub 341 and the HPC coupling nut 332 even for conditions when the HPC coupling nut 332 tends to separate.

As shown in FIG. 3, radial preload may be applied to the turbine rotor stack 324 through a first fit 420 between bearing 330 and an intermediary sleeve 465, a second fit 430 between intermediary sleeve 465 and a high pressure turbine (HPT) rotor arm 467, and a third fit 440 between HPT rotor arm 467 and the tie shaft 322.

The turbine rotors 325 may be axially preloaded and secured by the HPT lock nut 327 which may apply an axial preload force to hold the compressor rotor stack 313 and turbine rotor stack 324 together and produce the necessary friction to transmit torque. When the HPT lock nut 327 is tightened, the primary load path is transferred from the kickstand 343 to the cylindrical portion of the downstream hub 341 and through the turbine rotor stack 324, producing internal compression load in the compressor rotor stack 313 and turbine rotor stack 324 and tension load in the tie shaft 322.

The arrangement of the three fits 420, 430, and 440 may ensure that the compressor rotor stack 313 and turbine rotor stack 324 are reliably held together, will be capable to resist the forces to be encountered during use, and will transmit the necessary torque and satisfy dynamic stability requirements. All these functions may be accomplished within a minimal radial envelope and with a low-profile locking ring 485.

As a result of the arrangement described above, axial preload may be achieved with a single fastener, the tie shaft 322. The preload may be distributed between the primary path and the secondary path, via the kickstand 343, in a balanced manner such that there is a minimum loss in clamping capability while the dynamic stability is maintained for a long-span, high speed rotor, for example, a rotor that turns at a rate greater than 20,000 RPM. As illustrated in FIG. 3, the three fits 420, 430, 440 accomplish simultaneous radial support for the rotors stack, dynamic stability for the high pressure spool, and a leak-proof joint.

Although embodiments of this invention have been disclosed, a worker of ordinary skill in this art would recognize that certain modifications would come within the scope of this invention. For that reason, the following claims should be studied to determine the true scope and content of this invention. In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

The invention claimed is:

1. A turbine engine, comprising:

a first bearing on a first end of a unitary tie shaft;

an upstream hub threadably engaged with the tie shaft;

a compressor rotor stack supported by and operatively associated with the tie shaft and abutting the upstream hub;

a middle support member abutting the compressor rotor stack, the middle support member having a downstream hub and a soft spring kickstand;

a high pressure compressor coupling nut abutting the soft spring kickstand and threadably engaged with the tie shaft;

a turbine rotor stack operatively associated with the tie shaft and abutting the downstream hub;

a turbine rotor arm operatively associated with the turbine rotor stack and interferingly fitting with the tie shaft;

a high pressure turbine lock nut threadably engaged with the tie shaft and abutting the turbine rotor arm;

an intermediary sleeve interferingly fitting with the turbine rotor arm;

a second bearing having inner and outer races, the inner race interferingly fitting with an outside diameter of the intermediary sleeve; and a downstream lock nut threadably engaged with the tie shaft and abutting the high pressure turbine lock nut.

2. The turbine engine of claim 1 wherein as the high pressure compressor coupling nut is tightened, the soft spring kickstand and the compressor rotor accept a secondary compression load and a portion of the tie shaft between the upstream hub and the high pressure compressor coupling nut accepts a secondary tension load.

3. The turbine engine of claim 1, wherein the soft spring kickstand of the middle support member provides axial and radial reaction forces in the middle support member.

4. The turbine engine of claim 1, wherein the high pressure compressor coupling nut applies a preload force to the compressor rotor stack.

5. The turbine engine of claim 4, wherein the high pressure compressor coupling nut allows the compressor rotor stack to be installed separately from the high pressure turbine rotor.

6. The turbine engine of claim 1, wherein the high pressure compressor coupling nut and the high pressure turbine lock nut apply preload forces to the compressor and turbine rotor stacks.

7. The turbine engine of claim 1, wherein the tie shaft, turbine rotor arm, intermediate sleeve, and inner race interferingly fitting with one another creates a radial preload force.

8. The turbine engine of claim 7, wherein the high pressure turbine lock nut is secured by the downstream lock nut and wherein the downstream lock nut is a low-profile locking ring.

9. The turbine engine of claim 1, wherein the compressor rotor stack and the turbine rotor stack are provided with an axial preload via the consisting of the tie shaft.

10. A turbine engine, comprising:

a tie shaft, the tie shaft being one unitary piece;

a first bearing operatively associated with the tie shaft at a first end of the tie shaft;

a compressor rotor supported by and operatively associated with the tie shaft, the compressor rotor including a plurality of radially-extending compressor blades;

a combustor downstream of the compressor rotor which exhausts high speed air into a turbine having a high pressure turbine rotor;

an upstream hub upstream of and abutting the compressor rotor and threadably engaged with the tie shaft;

a middle support member between the compressor rotor and the turbine, the middle support member having a downstream hub and a soft spring kickstand;

a high pressure compressor coupling nut threadably engaged with the tie shaft and abutting and abutting the soft spring kickstand;

an aft high pressure turbine rotor support including:

a turbine rotor arm operatively associated with the high pressure turbine rotor and interferingly fitting with the tie shaft, a high pressure turbine lock nut threadably engaged with the tie shaft and abutting the turbine rotor arm, an intermediary sleeve interferingly fitting with the turbine rotor arm, and a second bearing having inner and outer races, the inner race interferingly fitting with an outside diameter of the intermediary sleeve; and a downstream lock nut threadably engaged with the tie shaft and abutting the aft high pressure turbine rotor support.

11. The turbine engine of claim 10, wherein as the high pressure compressor coupling nut is tightened, the compressor rotor and the soft spring kickstand accept a secondary compression load and a portion of the tie shaft between the upstream hub and the high pressure compressor coupling nut accepts a secondary tension load.

12. The turbine engine of claim 10, wherein the soft spring kickstand provides axial and radial reaction forces in the middle support member.

13. The turbine engine of claim 10, wherein the high pressure compressor coupling nut applies a preload force to the compressor rotor.

14. The turbine engine of claim 13, wherein the high pressure compressor coupling nut allows the plurality of radially-extending compressor blades to be installed separately from the high pressure turbine rotor.

15. The turbine engine of claim 10, wherein the high pressure turbine lock nut applies a primary preload force to the compressor rotor and to the high pressure turbine rotor.

16. The turbine engine of claim 15, wherein the tie shaft, turbine rotor arm, intermediate sleeve, and inner race interferingly fitting with one another produces a radial preload force.

17. The turbine engine of claim 10, wherein the compressor rotor and the turbine are provided with an axial preload via the tie shaft.

* * * * *